US008561869B2

(12) United States Patent
Towfighi

(10) Patent No.: US 8,561,869 B2
(45) Date of Patent: Oct. 22, 2013

(54) PNEUMATICALLY DRIVEN SETTING TOOL

(75) Inventor: Kaveh Towfighi, Shanghai (CN)

(73) Assignee: Hilti Aktiengesellschaft, Schaan (LI)

( * ) Notice: Subject to any disclaimer, the term of this patent is extended or adjusted under 35 U.S.C. 154(b) by 1217 days.

(21) Appl. No.: 11/510,243

(22) Filed: Aug. 24, 2006

(65) Prior Publication Data

US 2007/0045377 A1 Mar. 1, 2007

(30) Foreign Application Priority Data

Aug. 25, 2005 (DE) ..... 10 2005 000 107

(51) Int. Cl.
*B25C 1/04* (2006.01)

(52) U.S. Cl.
USPC ..... 227/130; 227/9; 227/10; 227/129

(58) Field of Classification Search
USPC ..... 227/9, 10, 111, 129, 130
See application file for complete search history.

(56) References Cited

U.S. PATENT DOCUMENTS 4,200,213 A * 4/1980 Liesse ..... 227/10
4,403,722 A * 9/1983 Nikolich ..... 227/8
5,213,247 A * 5/1993 Gschwend et al. ..... 227/10
6,425,354 B1 * 7/2002 Buchel et al. ..... 123/46 R
6,463,894 B2 * 10/2002 Hasler et al. ..... 123/46 R
6,666,366 B2 * 12/2003 Rosenbaum et al. ..... 227/8
7,004,366 B2 * 2/2006 Schiestl et al. ..... 227/8
7,275,673 B2 * 10/2007 Zahner et al. ..... 227/10
7,290,691 B1 * 11/2007 Wen et al. ..... 227/8
2007/0131731 A1 * 6/2007 Moeller et al. ..... 227/10

* cited by examiner

*Primary Examiner* — Hemant M Desai
*Assistant Examiner* — Gloria R Weeks
(74) *Attorney, Agent, or Firm* — Abelman, Frayne & Schwab

(57) ABSTRACT

A pneumatically driven setting tool for driving in fastening elements, includes a chamber (17) forming a storage chamber (22) for storing the pressure medium produced by the compression device (30, 130) and an expansion chamber (26) adjoining the drive-in piston (13), which is displaceable in a guide (12), at a side of the drive-in piston (13) remote from the piston stem (14), communicating with the storage chamber (22), and having an opening (18) connecting the expansion chamber (26) with the drive-in piston (13), at least one check valve (44, 54, 142) arranged between the compression device (30, 130) and the chamber (17), and a piston retaining device (47) for retaining the drive-in piston (13) in its initial position (80) in which the chamber (17) is sealed against the guide (12).

8 Claims, 5 Drawing Sheets

PNEUMATICALLY DRIVEN SETTING TOOL

BACKGROUND OF THE INVENTION

1. Field of the Invention

The present invention relates to a pneumatically driven setting tool including a drive-in piston displaceably supported in the guide, driven by a gaseous pressure medium, and having a piston stem, a compression device for providing the gaseous pressure medium for driving the drive-in piston, a storage chamber for storing the pressure medium produced by the compression device, and an expansion chamber adjoining the drive-in piston at a side of the drive piston remote from the piston stem, communicating with the storage chamber, and having an opening connecting the expansion chamber with the drive-in piston.

2. Description of the Prior Art

With setting tools described above, fastening elements are driven in a constructional component as a result of drive-in movement of a setting or drive-in piston. In these pneumatically driven setting tools, the setting or drive-in piston is accelerated by an expandable compressed gas volume produced by a compression device.

U.S. Patent Publication US 2002/0158102 A1 discloses a portable pneumatic setting tool having an integrated compression apparatus. The compression apparatus includes a motor and a compressor arranged in the tool housing. The motor is supplied with electrical energy from a battery releasably secured on the cover of the compression apparatus. The compressed air, which is produced by the compression apparatus is stored in a storage chamber and is fed, upon actuation of an actuation switch, into an expansion chamber located behind the piston which is driven by the expanding compressed air.

A drawback of the setting tool, which is disclosed in the above-mentioned U.S. publication, consists in that the compressor, together with the expansion chamber, occupy a large volume of the tool space.

German Publication DE 37 28 454 A1 discloses a pressure medium-driven percussion tool with a pneumatic drive piston which is supplied with compressed air from a compressor built-in the tool housing. The produced compressed air is stored in one or several storage chambers and, upon actuation of a control valve, drives the drive piston that impacts a fastener or the like. The compressor is driven by electric motor through an eccentric gear.

In the setting tool of DE 37 28 454 A1, a large space volume of the tool is needed for the compressor and the expansion chamber.

Accordingly, an object of the present invention is to provide a setting tool of the type discussed above that would have a small volume.

SUMMARY OF THE INVENTION

This and other objects of the present invention, which will become apparent hereinafter, are achieved by providing a pneumatically driven setting tool in which both the storage chamber and the expansion chamber are formed in a common chamber, at least one check valve is arranged between the compression device and the common chamber for enabling flow of the pressure medium into the chamber, and a piston retaining device for retaining the drive-in piston in its initial position in which the chamber is sealed against the guide, is provided.

The novel features of the present invention permit to noticeably reduced the constructional volume of the inventive setting tool.

According to an advantageous embodiment of the present invention, the piston retaining device is arranged sidewise of the tool bolt guide and has a locking member projecting into the bolt guide in a locking position, blocking a displacement path of the piston stem of the drive-in piston. The locking member is displaced out of the bolt guide to a release position in which the displacement path of the piston stem of the drive-in piston becomes free. The drive-in piston is retained in its position that seals the common chamber from the guide by the locking member of the piston retaining device and which is engages by the free end of the piston stem of the drive-in piston.

Advantageously, the setting tool has a control unit connected by a control conductor with the piston retaining device which the control unit controls. This permits to make available a maximum possible amount of the setting energy. This is because the control unit can actuate the piston retaining device at an optimal time point after actuation of the actuation switch.

Advantageously, the compression device has at least one cylinder arranged sidewise of the common chamber, at least one compression piston displaceable in the cylinder, a motor for driving the compression piston, and a transmission element for transmitting torque from the motor to the compression piston. The foregoing arrangement permits to further reduce the constructional volume of the setting tool.

It is further advantageous when the cylinder extends coaxially to a longitudinal axis of the setting tool and which is defined by the drive-in piston. In this way, the length of the expansion chamber can be used for the stroke of the compression piston.

According to a preferable embodiment of the invention, a compression member is displaceably arranged in the housing in which the chamber is located. This arrangement of the compression member permits to eliminate a separate chamber for the compression cylinder.

Advantageously, the compression member is formed as a piston plate having opening through which the pressure medium flows into the chamber and which is closeable with the check valve. The setting tool is provided with a spring for biasing the piston plate toward the guide. With this construction, the chamber is filled with air through the compression member, with the air being compressed upon displacement of the compression member in a direction toward the piston.

Advantageously, the compression member is displaced against a biasing force of the spring by a motor through a transmission element, whereby the chamber is expanded. This permits to keep the press-on force low as it doesn't need to be large enough to be able to displace the compression member against the spring biasing force.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
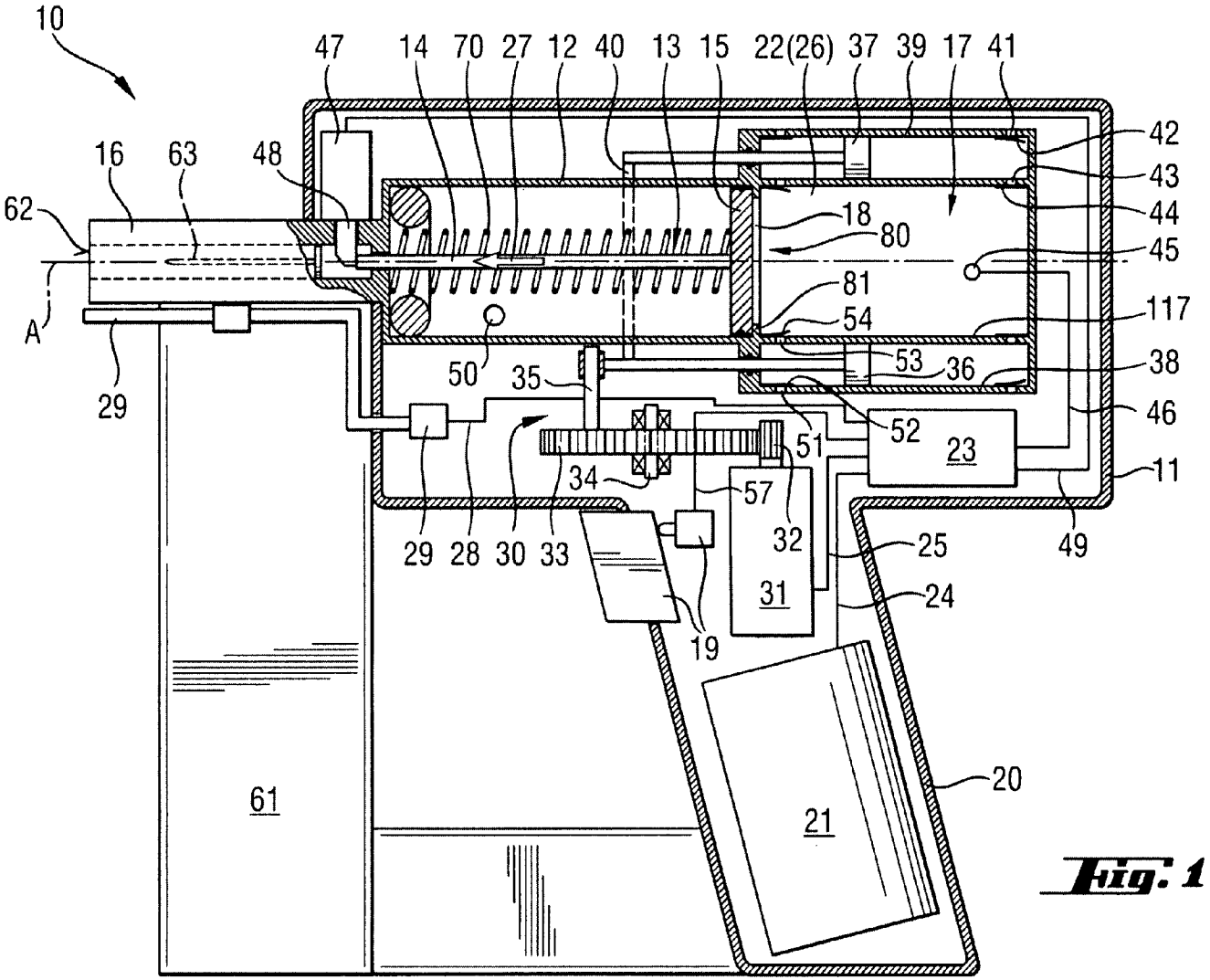
FIG. 1 a longitudinal cross-sectional view of a pneumatic setting tool according to the present invention.

A pneumatic setting tool 10 according to the present invention, which is shown in FIG. 1, includes a housing 11 in which a setting mechanism with a drive-in piston 13 is located. The drive-in piston 13 is displaceable in a cylindrical guide 12. The drive-in piston 13 has a piston head 15 and a piston stem 14 extending from the piston head 15 in a direction of a bolt guide 16 that adjoins the cylindrical guide 12. At the end of the guide 12 remote from the bolt guide 16, there is provided a housing 117 having a chamber 17 that communicates with the guide 12 through an opening 18. The opening 18 is surrounded by a circumferential projection 81 which the piston head 15 engages in its initial position 80 shown in FIG. 1. In the initial position 80, the drive-in piston 13 is retained by a piston holding device 47. The piston holding device 47 has a locking member 48 that projects in the bolt guide 16 and blocks the piston stem 14. The piston holding device 47 is formed, e.g., as a solenoid and is connected by a control conductor 49 with a control unit 23.

A magazine 61, in which fastening elements 63 are stored, projects sidewise from the bolt guide 16.

The setting tool 10 further includes a handle 20 on which an actuation switch 19 for initiating a drive-in process with the setting tool 10 is arranged. In the handle 20, there is located a power source designated generally with a reference numeral 21 and which supplies the setting tool 10 with an electrical energy. The power source 21 includes at least one accumulator. The power source 21 is connected with the control unit 23 by an electrical conductor 24. The control unit 23 is further connected with the actuation switch 19 by a switch conductor 57. At a mouth 62 of the setting tool 10, there is arranged switching means 29 connected with the control unit 23 by an electrical conductor 28. The switching means 29 generates an electrical signal and communicates it to the control unit 23 as soon as the setting tool is pressed against a constructional component, insuring that the setting tool 10 can only then be actuated when it is properly pressed against the constructional component.

For driving the drive-in piston 13, the setting tool 10 includes a compression unit designated generally with a reference numeral 30. The compression unit 30 includes an electrically driven motor 31 with a take-off element 32 that drives a transmission element 33. The transmission element 33 is rotatably supported on a support axle 34 and can be formed, e.g., as a flywheel with circumferential toothing that is engaged with the toothing of the take-off element 32. Instead of a single transmission element 33, there can be provided, e.g., several transmission elements connected one after another. The transmission element 33 carries an eccentrically arranged pin 35 that engages in an elongate opening of a crank rod 40. The crank rod 40 carries two compression pistons 36, 37 displaceable parallel to each other. The two pistons 36, 37 reciprocate in respective cylinders 38, 39 extending parallel to a longitudinal axis A of the setting tool 10 and which is defined by the drive-in piston 13. The cylinders 38, 39 are arranged sidewise of the chamber 17 and have, respectively, a first channel 43 at their ends remote from the opening 18 and a second channel 53 at their ends adjacent to the opening 18. The respective first and second channels 43, 53 open into the chamber 17 and are provided with respective check valves 44, 54 which provide for flow of medium from the cylinders 38, 39 into the chamber 17. The cylinders 38, 39 further have respective first and second suction openings 41, 51 that open into the interior of the housing 11 and arranged opposite the channels 43, 53. The openings 41, 51 are likewise provided with the check valves 42, 52 which provide for flow from the interior of the housing 11 in the cylinders 38, 39.

The motor 31 of the compression unit 30 is connected with the control unit 23 by an electrical conductor 25 through which an actuation signal is transmitted from the control unit 23 to the motor 31. The motor 31 can, e.g., be already actuated by the control unit 23 when a main switch, not shown, is actuated. With the actuated motor 31, the compression unit 30 becomes operational and pumps compressed air with the reciprocating pistons 36, 37 into the chamber 17 that serves only as storage chamber 22. When a predetermined maximal pressure is reached in the storage chamber 22, then the control unit 23 communicates via the conductor 25 a stop signal to the motor 31. To this end, a pressure-responsive sensor 45 is arranged in the chamber 17. The sensor 45 is connected with the control unit 23 by a sensor conductor 46.

With the setting tool 10 being pressed against a constructional component (not shown), a corresponding signal is communicated by the switching means 29 to the control unit 23 via the conductor 28.

When a setting tool user actuates the actuation switch 19, the control unit 23 actuates, via a control conductor 49, a piston retaining device 47. The device 47 withdraws a locking member 48 out of the bolt guide 16, freeing the piston stem 14. The drive-in piston 13 is then driven by the compressed air in the chamber 17, which now functions as an expansion chamber 26, in a drive-in direction 27 for driving a fastening element 63 into a constructional component. During the displacement of the drive-in piston 13, air, which is located in front of the piston head 15 in the drive-in direction and, subsequently, the compressed air behind the piston head 15 can leave the guide 12 through an exhaust opening 50.

During the drive-in process, the compression unit 30 is deactuated by the control unit 23 in order to enable the return of the drive-in piston 13 to its initial position by the return element 70. The return element 70 can be formed, e.g., as a helical spring.

After return of the drive-in piston 13 in its initial position, the locking member 48 of the piston retaining device 47 is displaced, by a spring in a direction of its locking position in the bolt guide 16, blocking the drive-in piston 13 from displacement in the drive-in direction 27. The piston retaining device 47 communicates to the control unit 23 the displacement of the locking member 48 into the locking position, so that the control unit 23 again actuates, via a motor conductor 25, the compression unit 30 until a predetermined maximal pressure is reached in the storage chamber 22.

Figure 2:
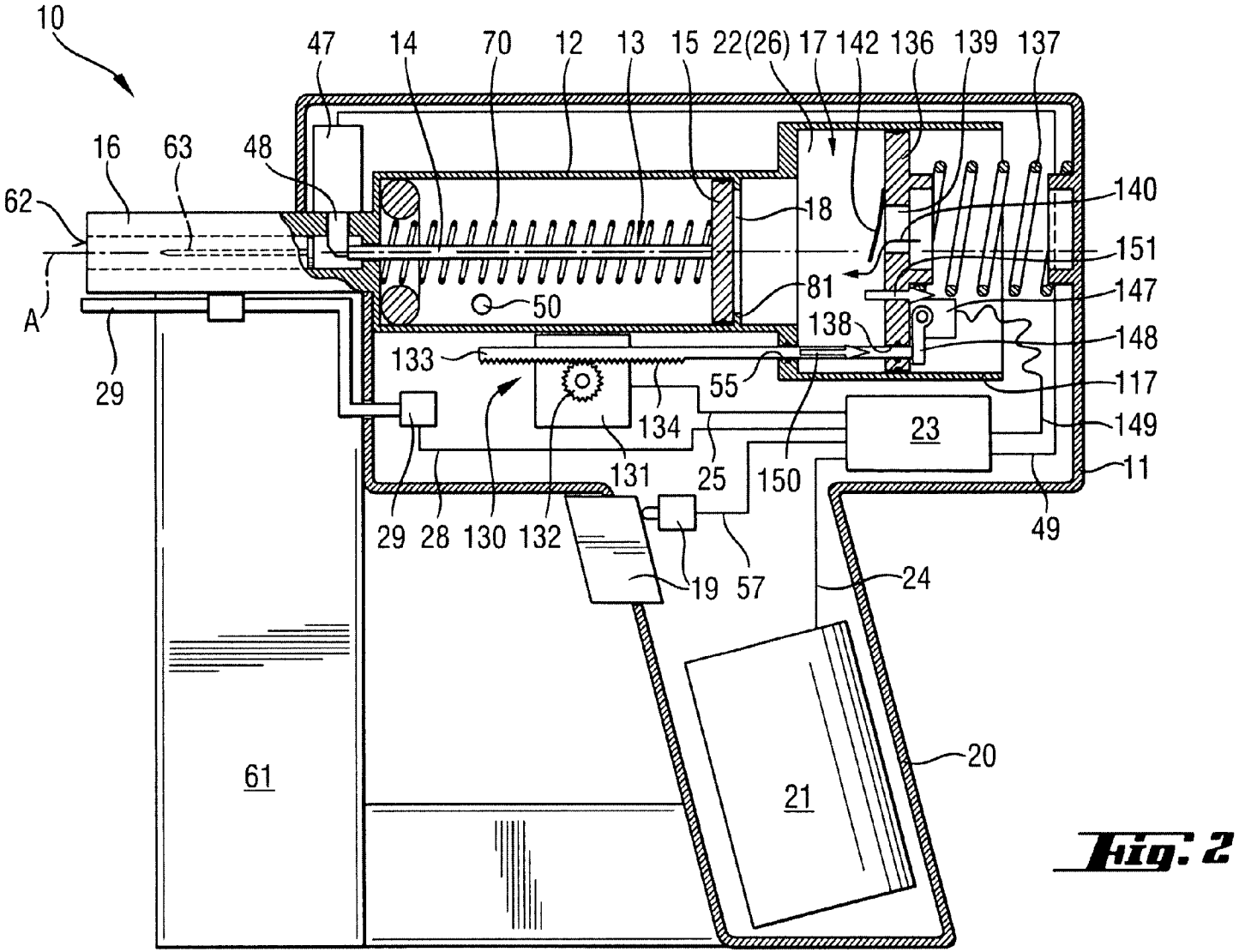
FIG. 2 a longitudinal cross-sectional view of another embodiment of a pneumatic setting tool according to the present invention.
Figure 3:
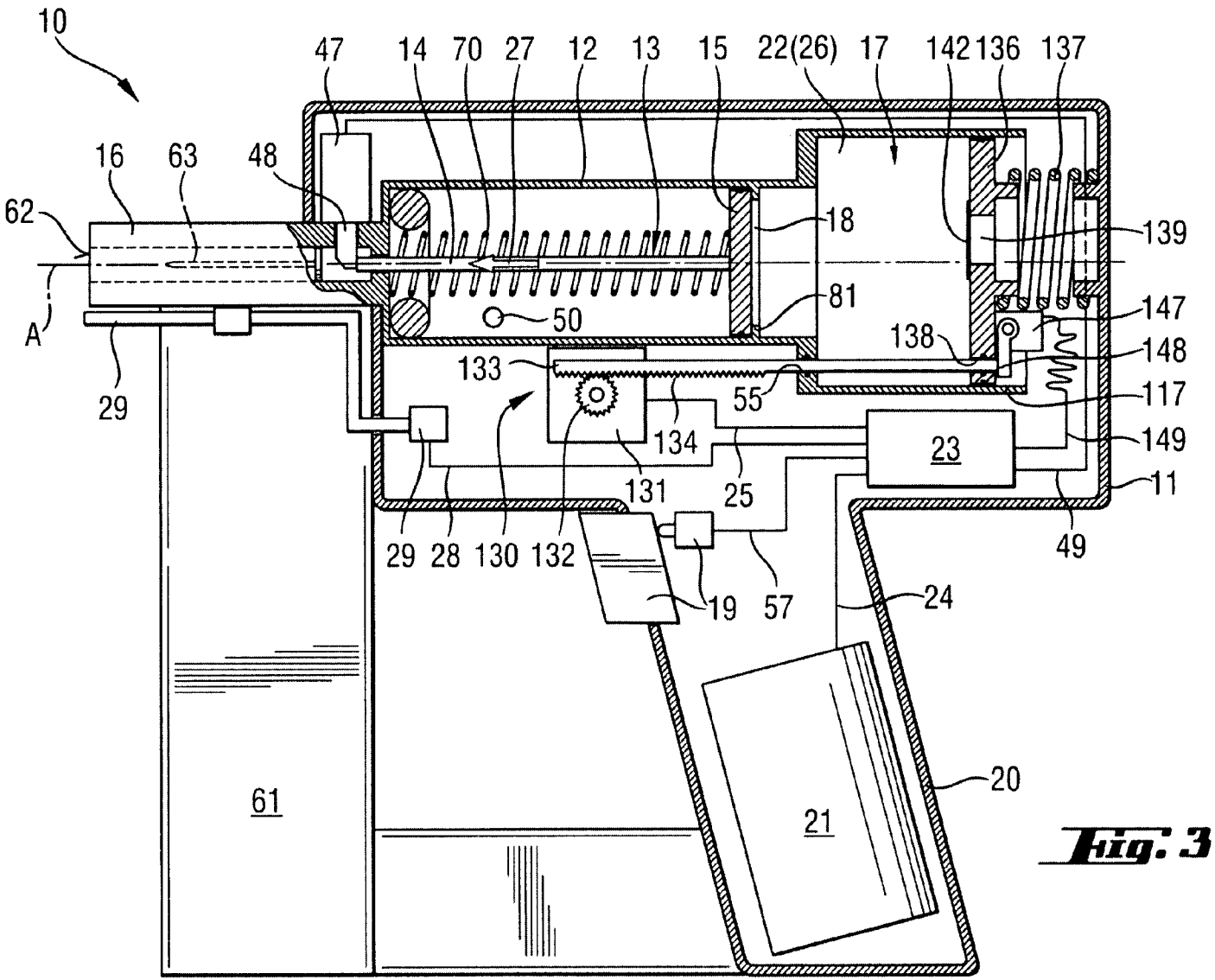
FIG. 3 a longitudinal cross-sectional view of the setting tool shown in FIG. 2 in a press-on position, FIG. 4 a longitudinal cross-sectional view of the setting tool shown in FIG. 2 in an actuated position.
Figure 4:
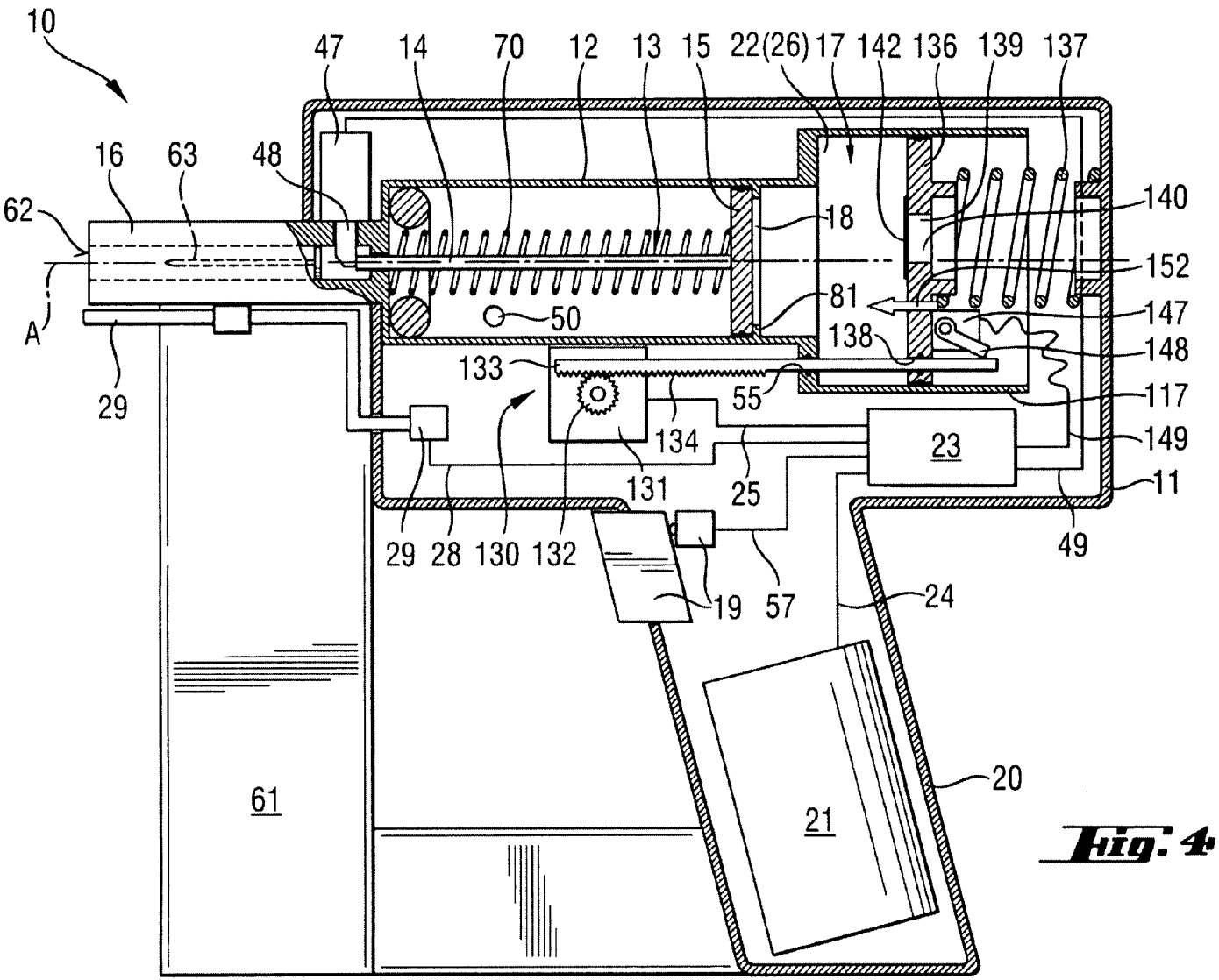
Figure 5:
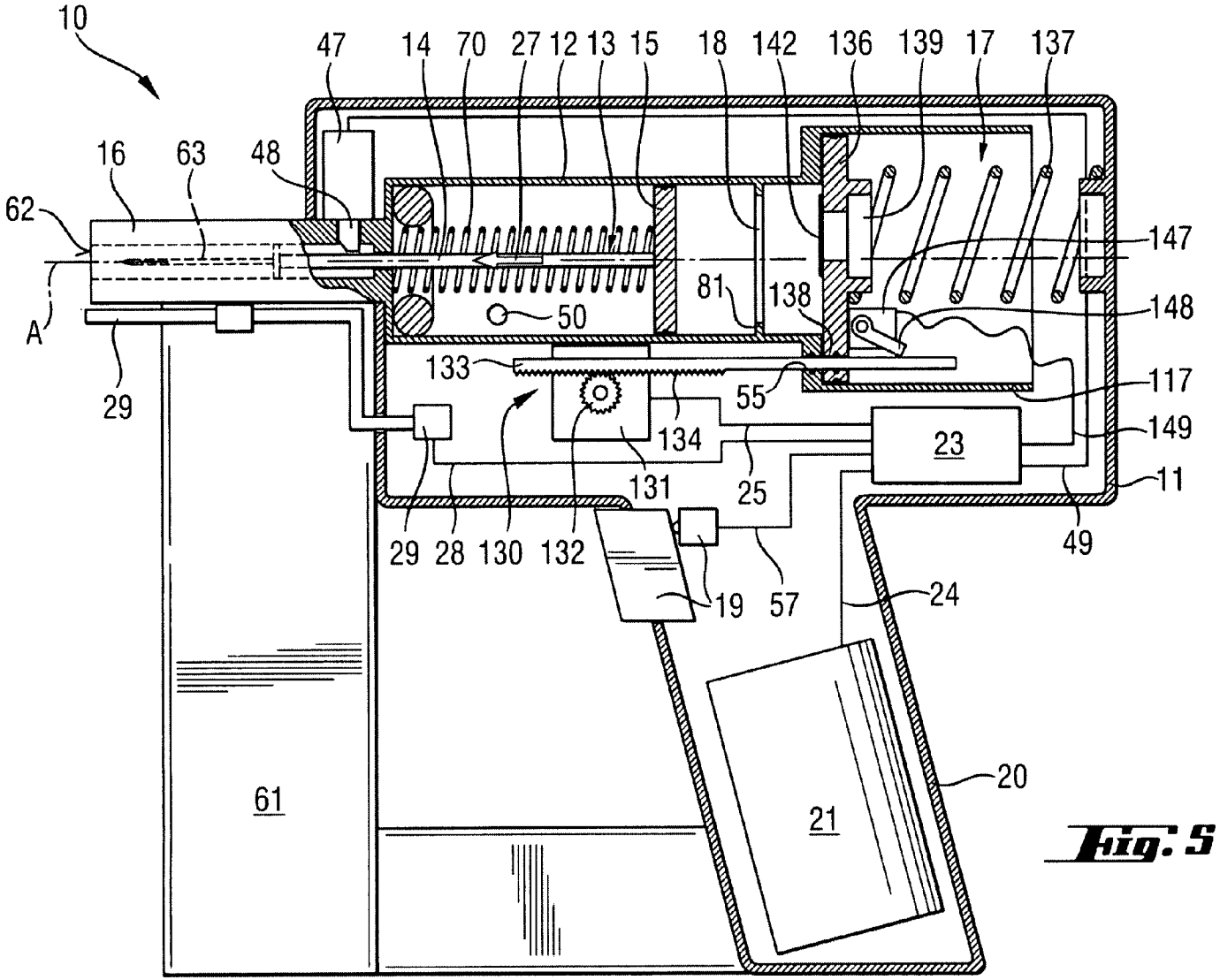
FIG. 5 a longitudinal cross-sectional view of the setting tool shown in FIG. 2 after completion of a setting process.

The setting tool 10, which is shown in FIGS. 2-5, differs from that described above by construction of the compression unit 130. The setting tool has, as the setting tool described above, a housing 117 with the chamber 17 that functions both as the storage chamber 22 and as the expansion chamber 26. The compression unit 130 has a motor 131 having a take-off element 132 formed as a gear wheel that engages toothing 134 of a rack-shaped transmission element 133. The transmission element 133 projects with its end remote from the toothing 134 through the opening 55 in the housing 117 into the chamber 17. A compression member 136, which is formed as a displaceable piston plate is arranged in the housing 117. The compression member 136 is supported against the tool housing 11 by a spring 137. In the compression member 136, there is formed an opening 138 through which the transmission element 133 is extendable. In the region of the opening 138, on the side of the compression member 136 adjacent to the spring 147, a locking element 147 is arranged. A control conductor 149 connects the locking element 147 with the control unit 23. The control element 147 has a locking member 148 which in a locking position shown in FIG. 2, is located directly in front of the opening 138, locking the compression member 136 with the transmission element 133. In the compression member 136, there is further provided a further opening 139 with which a check valve 142, which is provided on a side of the compression member 136 adjacent to the drive-in piston 13, is associated. The check valve 142 controls flow of air through the opening 139 into the chamber 17 or the storage chamber 22 formed by the chamber 17.

The motor 131 can, e.g., be actuated when the control unit 23 is actuated by a main switch, not shown. The motor 131 displaces the transmission element 133 in a direction of arrow 150. Thereby, the transmission element 133 displaces the compression member 136, due to the locking position of the locking member 148, against a biasing force of the spring 147 in a direction of arrow 151, expanding the chamber 17 or the expansion chamber 26 through the opening 139, the air can flow into the expansion chamber 26, as shown with arrow 140. The motor 131 is controlled by the control unit 23 so that the transmission element 133 and, thereby, the compression member 136, are displaced a predetermined distance in the direction of the arrows 150, 151 and then is deactuated.

When the setting tool 10 is pressed against a constructional component (not shown) a corresponding signal is generated by the switching means 29 and is communicated to the control unit 23 via the conductor 28. Upon actuation of the actuation switch 19 by the tool user, the control unit 23 actuates the locking element 147 via the control conductor 149. The locking element 147 displaces the locking member 148 in a release position shown in FIG. 4. The compression member 136 would displace along the transmission element 133 by the compressed spring 137 in direction of arrow 152. Thereby, the air, which occupies the space between the drive-in piston 13 and the compression member 136 in the chamber 17 is compressed. Then, the control unit 23 actuates, via the control conductor 49, the piston retaining device 47 as a result of which the locking member 48 is withdrawn from the bolt guide 16, freeing the piston stem 14. The drive-in piston 13 is driven by the compressed air, which is located in the chamber 17 that now functions only as expansion chamber 26, for driving a fastening element 63 in the constructional component. During the displacement of the drive-in piston 13, the air, which is located in front of the piston head 15 in the drive-in direction, can be rented outwardly through the exhaust opening 50 out of the guide 12. Thereafter, the compressed air behind the piston head 15 is also released, through the exhaust opening 50.

The return of the drive-in piston 13 is effected in the same way as described with reference to the setting tool shown in FIG. 1. After the piston 13 occupies its initial position, the locking member 48 of the piston retaining device 47 can be displaced into its locking position in the bold guide 16 by a spring, blocking the displacement of the drive-in piston 13 in the drive-in direction 27. The piston retaining device 47 communicates, to the control unit 23, a control signal indicating the displacement of the locking member 48 into its locking position, so that the control unit 23 can again actuate, via the motor conductor 25, the compression unit 130 until the compression member 136 reaches its position shown in FIG. 3 in which the expansion chamber 22 is expanded and is filled with air.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A compressed air driven setting tool for driving in fastening elements, comprising a guide (12); a drive-in piston (13) displaceable in the guide by a compressed air; a chamber (17) adjoining the guide (12) and having an opening (18) connecting the chamber (17) with the guide (12) and closed by the piston (13) in an initial position of the setting tool, the chamber (17) serving as a storage chamber for the compressed air in the initial position of the setting tool for storing the compressed air and serving as an expansion chamber in an operational positions of the setting tool and the piston (13); a compression device (30) for producing the compressed air and for feeding the compressed air into the chamber (17) in the initial position of the setting tool; at least one check valve (44, 54, 142) arranged between the compression device (30) and the chamber (17) for enabling flow of the compressed air from the compression device (30) into the chamber (17); and a piston retaining device (47) for retaining the drive-in piston (13) in the initial position (80) thereof against the pressure of the compressed air in the chamber (17).

2. A setting tool according to claim 1, further comprising a bolt guide (16), and wherein the piston retaining device (47) is arranged sidewise of the bolt guide (16) and has a locking member (48) projecting into the bolt guide (16) in a locking position thereof, blocking a displacement path of the piston stem (14) of the drive-in piston (13), and displaceable out of the bolt guide (16) to a release position thereof, in which the displacement path of the piston stem (14) of the drive-in piston (13) becomes free, in response to displacement of the setting tool from the initial position thereof to the operational position thereof.

3. A setting tool according to claim 1, further comprising a control unit (23); and a control conductor (49) for connecting the control unit (23) with the piston retaining device (47) for controlling same.

4. A setting tool according to claim 1, wherein the compression device (30) has at least one cylinder (38, 39) arranged laterally of the chamber (17), at least one compression piston (36, 37) displaceable in the cylinder (38, 39); a motor (31) for driving the compression piston (38, 39), and transmission means (33) for transmitting torque from the motor (31) to the compression piston (38, 39).

5. A setting tool according to claim 4, wherein the cylinder (38, 39) extends parallel to a longitudinal axis (A) of the setting tool (10) and defined by the drive-in piston (13).

6. A setting tool according to claim 1, comprising a housing (117) in which the chamber (17) is located, and wherein the compression device (130) comprises a compression member (136) displaceably arranged in the chamber housing (117).

7. A setting tool according to claim 6, wherein the compression member (136) is formed as a piston plate and has an opening (139) through which the compressed medium flows into the chamber (17) and which is closable with the check valve (142), and wherein the setting tool further comprises spring means for biasing the piston plate toward the guide (12).

8. A setting tool according to claim 7, wherein the compression device (130) further includes a motor (131) for displacing the compression member (136) against a biasing force of the spring means in order to expand the chamber (17), and transmission means (133) for transmitting torque from the motor (131) to the compression member (136).

* * * * *